US005092606A

United States Patent [19]

Miller

[11] Patent Number: 5,092,606

[45] Date of Patent: Mar. 3, 1992

[54] BOARD GAME

[76] Inventor: William R. Miller, 10101 Glades Rd., Ste. G-10, Boca Raton, Fla. 33498

[21] Appl. No.: 602,622

[22] Filed: Oct. 24, 1990

[51] Int. Cl.[5] ..... A63F 3/00

[52] U.S. Cl. ..... 273/249

[58] Field of Search ..... 273/242, 243, 248, 249

[56] References Cited

U.S. PATENT DOCUMENTS

| | | | |
|---|---|---|---|
| 1,391,333 | 9/1921 | McManus | 273/249 |
| 2,792,227 | 5/1957 | Auerbach | 273/249 |
| 3,815,919 | 6/1974 | Cain et al. | 273/249 |
| 3,926,438 | 12/1975 | Brescow et al. . | |
| 3,939,578 | 2/1976 | Coffey | 35/9 R |
| 3,955,818 | 5/1976 | Hawke . | |
| 4,441,718 | 4/1984 | Olson | 273/242 |
| 4,807,878 | 2/1989 | Tripp | 273/237 |
| 4,884,816 | 12/1989 | Ford et al. | 273/272 X |
| 4,932,666 | 6/1990 | Corle | 273/249 |
| 4,962,934 | 10/1990 | Taylor | 273/249 |
| 4,991,854 | 2/1991 | Weiss | 273/249 |

*Primary Examiner*—Edward M. Coven
*Assistant Examiner*—William E. Stoll
*Attorney, Agent, or Firm*—Alvin S. Blum

[57] ABSTRACT

A board game has two chance taking devices such as spinners, dice for generating two numbers. A first number selects the number of a question on a question card from a deck of question cards that must be answered correctly. On the board is imprinted a first, direct path of connected spaces from start to win and a second, serpentine path of connected spaces that periodically intersects the first path at common, intersecting spaces. Each player's token is moved a particular number of spaces determined by the second change taking device. Complexity is introduced by what happens when a token is on an intersecting space at the start of a turn. If the question is answered correctly, the token advances along the direct path. If answered incorrectly the token moves one space onto one or the other side of the direct path onto a loop of the second path. Which side it moves is indicated on the question card. On one side the token is advancing and on the other side it is retreating. The token must continue to move in that direction until the next intersecting space is reached before returning to the direct path to the goal.

13 Claims, 1 Drawing Sheet

BOARD GAME

BACKGROUND OF THE INVENTION

This invention relates to board games with chance devices and more particularly to a game and method for playing with pieces that move over branched pathways combining chance devices and skill in answering prerecorded questions.

Board games are well known wherein each player has a piece that moves a particular number of spaces along a path based upon chance of a die or spinner. Some of these include a player answering questions recorded on cards such as U.S. Pat. No. 3,939,578 issued 2/24/76 to Coffey. Certain games use both a die and a spinner such as U.S. Pat. No. 3,926,438 issued 12/16/75 to Breslow et al. A branching pathway movement on a board is disclosed by U.S. Pat. No. 3,955,818 issued 5/11/76 to Hawke. And U.S. Pat. No. 4,441,718 issued 8/10/84 to Olson discloses a biblical game simulating spread of the new testament through the Roman Empire.

There is a need to provide a game which teaches information in an exciting and challenging fashion and that can be played at different levels of expertise.

SUMMARY OF THE INVENTION

It is accordingly an object of the invention to provide a board game that is exciting and challenging with an element of chance and considerable diversity in the progress of the game. It is another object of the invention to provide a game which teaches and challenges knowledge of the Bible that can be readily adapted for different levels of knowledge on the subject so that it may be played by younger and older Sunday School students, for example.

The board game of the invention includes a game board with a pattern thereon for movement of player's tokens along a first path of connected spaces from a start space to a finish or win position at the far end. A second path of connected spaces periodically intersects the first path at common, intersecting spaces. The second path is much longer than the first path, requiring many more moves to reach the finish. This includes means for moving away from the finish as well.

A set of cards are provided. Each card has a set of six numbered questions on a face side and answers on the reverse side and also a designation of left or right.

Two chance taking devices such as spinners, dice and the like are provided. A first gives a number from 1 to 6 to indicate which question the player must answer. If the player answers correctly he advances a number of spaces indicated by a second chance taking device.

Means are provided for diverting the player from the first path to the longer second path in a forward or reverse direction and back to the first path under certain conditions of play to add complexity and excitement not found in a simple direct pathway.

These and other objects, features and advantages of the invention will become more apparent when the detailed description is read in conjunction with the drawings.

DETAILED DESCRIPTION OF PREFERRED EMBODIMENT

Figure 1:
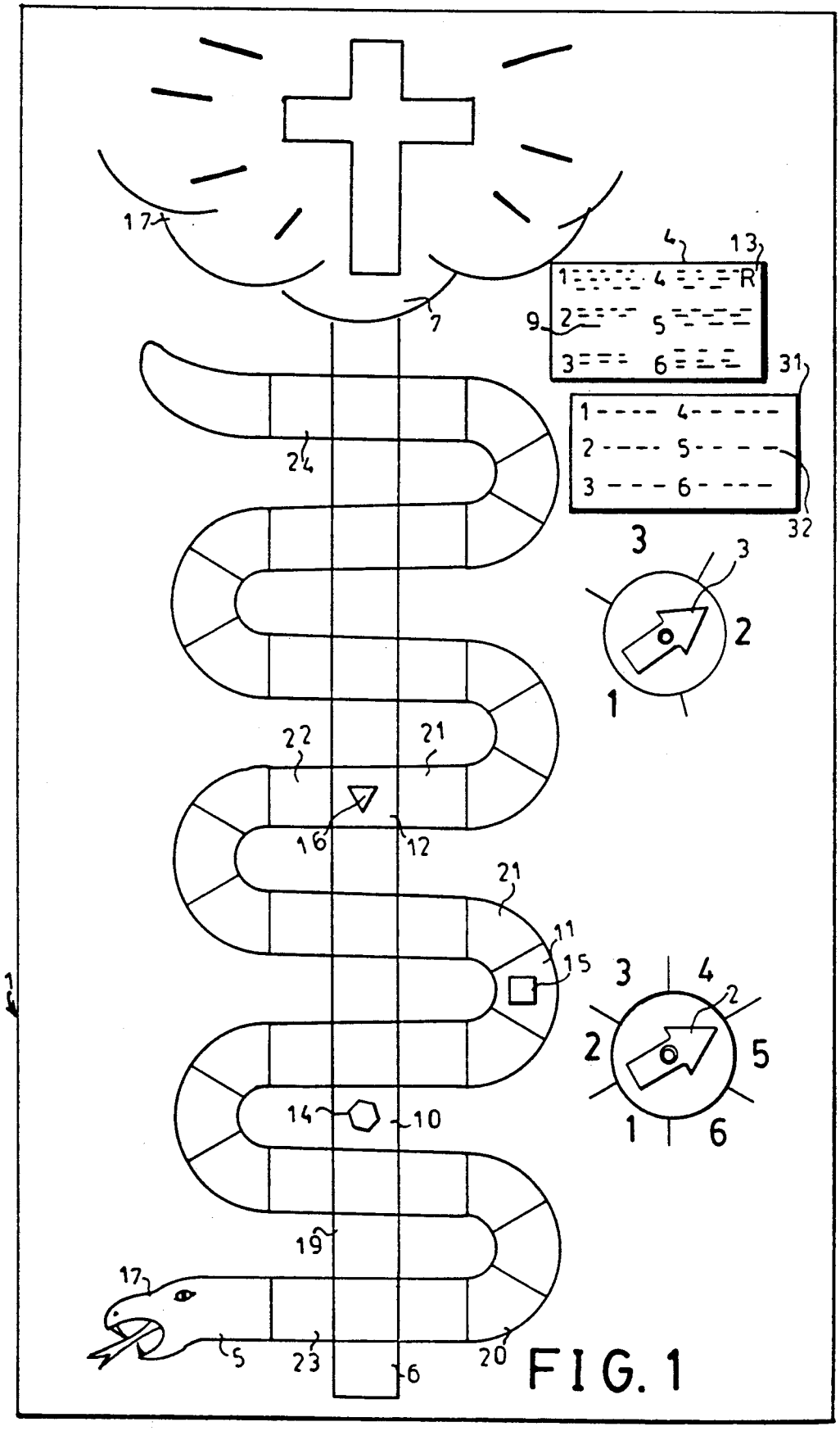
FIG. 1 is a top view of one embodiment of the game board with three player's tokens and a set of cards thereon.

Referring now to the drawing, FIG. 1 shows a game board 1 that may be of the conventional board type with an imprinted top sheet or a flexible sheet that rolls up. The board includes two chance taking devices of the spinner type. An optional die type of chance taking device 30 is also shown. The first spinner 2 selects a number from one to six. A deck of cards 4 is supplied. Each card has imprinted on its face side, either the letter R, as shown or the letter L (not shown) and a set of six numbered questions 9 on the Bible. Alternatively, the questions may be on other religious subjects or may be directed to completely different subject matter as well. On the reverse side 31 of each card are the answers 32 to the numbered questions. The player tries to answer the question selected by the first spinner number.

Each player is assigned a distinctive token 14, 15, 16 that may have a shape related to the subject matter of the game. Imprinted on the board may be various decorative matter 5, 17 and a first, direct or straight path 19 of connected spaces 10 along which the token may move from a start position 6 to a finish or win position 7. A serpentine or deviant path 20 of connected spaces 11 coils about or across the direct path 10 and intersects at common intersecting spaces 12. The serpentine path thus provides a longer path with more spaces to reach the goal or win position 7.

If the players answer the question correctly, the token is advanced along path 19 by the number of spaces indicated by the second spinner 3.

TOKEN STARTING ON INTERSECTING SPACE

If the player answers the question correctly when token is on an intersecting space 12 at the start of a turn, the token is advanced along direct path 19 toward goal 7.

If the token is on an intersecting space 12 at the start of a turn and the question is not answered correctly, the token must be moved one space onto the serpentine path loop either left 22 or right 21, depending upon whether an L or R appears on the question card 4 at 13. From this junction space 12, the token is advancing when it moves to the right, although at a slower rate than on the straight path, and retreating when it moves to the left. Once on a loop, either advancing or retreating, it must continue in that same direction on the next turn. If it is retreating, i.e. going back toward the start 6, then it may stop when it reaches the next junction space. If it is advancing, it must continue to advance. It must continue to advance along serpentine path 20. If it lands on an intersecting space at the end of a move, the rules for starting on an intersecting space again apply on the player's next turn.

These changes in direction and path length add excitement and variation to the game. Different sets of cards may be provided for different levels of skill, subject matter, and for renewal after all the answers are learned. Additional playing rules may be added, such as requiring an exact number of moves to reach the finish space such as space 7 or one space past that point.

The chance taking device may be any of the chance taking devices known in the art such as dice, numbered tops and the like.

There may be a requirement that when a player enters the winning space, another question must be answered to win. If answered incorrectly the token is moved back one space. If answered correctly the other players may be given a turn to possibly advance to the win space.

A showdown condition may apply when two or more tokens occupy the same space. This may permit an advancing move or win only when one player answers a next question correctly and the other answers a next question incorrectly and moves back a space. There may be other variations on the rules and procedures to further enhance the enjoyment of the game.

A head space 23, and tail space 24 may be provided on the serpentine path for additional complexity. The token may enter that space from the opposite loop when the second spinner 3 indicates a number equal to or greater than the number of spaces needed to reach that space. If the token is on the intersecting space adjacent to space 23 or 24 and the player answers incorrectly and the direction on the card indicates that direction, then the token is moved into that space.

To escape from space 23 or 24 player must answer a question correctly with normal rules applying thereafter.

The above disclosed invention has a number of particular features which should preferably be employed in combination although each is useful separately without departure from the scope of the invention. While I have shown and described the preferred embodiments of my invention, it will be understood that the invention may be embodied otherwise then as herein specifically illustrated or described, and that certain changes in the form and arrangement of parts and the specific manner of practicing the invention may be made within the underlying idea or principles of the invention within the scope of the appended claims.

I claim:

1. A board game comprising:

A) a plurality of playing pieces including one piece for each player of said game;

B) a game board means for playing said game, said board means having indicia thereon over which said playing pieces are to be moved at chance-determined intervals and having displayed thereon a connected series of spaces defining paths over which the pieces are to be moved;

C) a first chance device for generating a random number;

D) a second chance device for generating a random number;

E) a means for randomly indicating direction;

F) a set of question cards in which each card is provided on a side with a numbered list of questions, one of which is to be answered by a player on his turn in playing said game;

G) a plurality of connected spaces on said board means defining a short, first path of travel for said pieces from a start location to a finish location or goal;

H) a plurality of connected spaces on said board means defining a long, second path of travel for said pieces and periodically intersecting said first path at common, intersecting spaces, wherein the number of spaces along said second path is greater than the number of spaces along said first path between adjacent ones of said intersecting spaces;

I) said first chance device generating a number indicating a particular one of said numbered questions from said list on said card to be asked of a player;

J) said second chance device generating a number indicating a particular number of spaces to move said piece along one of said paths when said question is answered correctly;

K) in which movement of said piece from one of said intersecting spaces to one of two paths is based upon correctness of answer to a selected question by a player and chance, whereby, when a question is answered correctly, said piece is moved along said first path toward said goal a number of spaces indicated by said second chance device, and upon incorrect answer said piece is moved at least one space onto said intersecting second path in a first or second direction as indicated by a means for randomly indicating direction, in which said first direction is toward a next intersecting space closer to said goal and said second direction is toward a next intersecting space farther from said goal.

2. The game according to claim 1 in which correct answers to said questions are provided on the reverse side of said cards.

3. The game according to claim 1 in which said means for randomly indicating direction is indicia carried by said cards indicating whether a piece is to be moved left or right on said second path from said intersecting space.

4. The game according to claim 1 in which said chance device includes at least one spinner.

5. The game according to claim 1 in which said chance device includes at least one die.

6. The game according to claim 1 in which said questions are directed to knowledge of the Bible.

7. The game according to claim 1 in which said board means is a stiff board imprinted on at least one face.

8. The game according to claim 1 in which said board means is flexible for rolling up for storage.

9. A board game comprising:

A) a plurality of playing pieces including one piece for each player of said game;

B) a game board means for playing said game, said board means having indicia thereon over which said playing pieces are to be moved at chance-determined intervals and having displayed thereon a connected series of spaces defining paths over which said pieces are to be moved;

C) a plurality of connected spaces on said board means defining a short, first path of travel for said pieces from a start location to a finish location or goal;

D) a plurality of connected spaces on said board means defining a long, second path of travel for said pieces and periodically intersecting said first path at common, intersecting spaces, wherein the number of spaces along said second path is greater than the number of spaces along said first path between adjacent ones of said intersecting spaces;

E) number indicating means for indicating a particular number of spaces to move said piece; and F) direction indicating means for directing movement of said piece from one of said intersecting spaces to one of three alternate directions:

1) a first direction along said short, first path of travel toward said goal;

2) a second direction along said long, second path of travel in a direction toward said goal; and 3) a third direction along said long, second path of travel in a direction away from said goal.

10. The board game according to claim 9, in which said number indicating means for indicating a particular number of spaces to move includes a random number generator.

11. The board game according to claim 9, in which said number indicating means for indicating a particular number of spaces to move is related to a player response based on player skill.

12. The board game according to claim 9, in which said direction indicating means for directing movement includes a chance means for indicating direction.

13. The board game according to claim 9, in which said direction indicating means for directing movement includes a player response based on player skill.

* * * * *